US005958216A

United States Patent [19]

Glover

[11] Patent Number: 5,958,216

[45] **Date of Patent: *Sep. 28, 1999**

[54] CATALYTIC REFORMING PROCESS WITH MULTIPLE ZONES

[75] Inventor: Bryan K. Glover, Algonquin, Ill.

[73] Assignee: UOP LLC, Des Plaines, Ill.

[ * ] Notice: This patent is subject to a terminal disclaimer.

[21] Appl. No.: 09/215,999

[22] Filed: Dec. 18, 1998

[51] Int. Cl.[6] ..... C10G 35/04; C10G 35/06

[52] U.S. Cl. ..... 208/64; 208/65; 208/139; 208/137

[58] Field of Search ..... 208/139, 65, 64, 208/137

[56] References Cited

U.S. PATENT DOCUMENTS

| | | | |
|---|---|---|---|
| 3,287,253 | 11/1966 | McHenry, Jr. et al. | 208/65 |
| 4,645,586 | 2/1987 | Buss | 208/65 |
| 4,985,132 | 1/1991 | Moser et al. | 208/65 |
| 5,190,638 | 3/1993 | Swan, III et al. | 208/65 |
| 5,885,439 | 3/1999 | Glover | 208/64 |

*Primary Examiner*—Walter D. Griffin
*Assistant Examiner*—Tam M. Nguyen
*Attorney, Agent, or Firm*—Thomas K. McBride; John F. Spears, Jr.; Richard E. Conser

[57] ABSTRACT

A hydrocarbon feedstock is catalytically reformed in a sequence comprising a first bifunctional-catalyst reforming zone, a zeolitic-reforming zone containing a catalyst comprising a platinum-group metal and a nonacidic zeolite, and a terminal bifunctional catalyst reforming zone. The first and terminal bifunctional catalysts preferably comprise a lanthanide-series metal component. The process combination permits higher severity, higher aromatics yields and/or increased throughput relative to the known art, and is particularly useful in connection with moving-bed reforming facilities with continuous catalyst regeneration.

20 Claims, No Drawings

CATALYTIC REFORMING PROCESS WITH MULTIPLE ZONES

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is practiced in nearly every significant petroleum refinery in the world to produce aromatic intermediates for the petro- chemical industry or gasoline components with high resistance to engine knock. Demand for aromatics is growing more rapidly than the supply of feedstocks for aromatics production. Moreover, increased gasoline upgrading necessitated by environmental restrictions and the rising demands of high-performance internal-combustion engines are increasing the required knock resistance of the gasoline component as measured by gasoline "octane" number. A catalytic reforming unit within a given refinery, therefore, often must be upgraded in capability in order to meet these increasing aromatics and gasoline-octane needs. Such upgrading could involve multiple reaction zones and catalysts and, when applied in an existing unit, would make efficient use of existing reforming and catalyst-regeneration equipment.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke. Continuous catalytic reforming, which can operate at relatively low pressures with high-activity catalyst by continuously regenerating catalyst, is effective for dehydrocyclization.

U.S. Pat. No. 3,287,253 (McHenry, Jr. et al.) discloses a reforming process comprising three different catalyst zones. The first zone contains a non-acidic, non-halogen-retaining catalyst, the intermediate stage contains a catalyst comprising an acidic support which promotes isomerization and the final stage is directed to dehydrocyclization of paraffins. The sequence of stages of McHenry, Jr. et al. thus contrasts sharply with that of the present invention.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed. Nevertheless, this dehydrocyclization technology has been slow to be commercialized during the intense and lengthy development period. The present invention represents a novel approach to the complementary use of L-zeolite technology.

U.S. Pat. No. 4,645,586 (Buss) teaches contacting a feed with a bifunctional reforming catalyst comprising a metallic oxide support and a Group Vil metal followed by a zeolitic reforming catalyst comprising a large-pore zeolite which preferably is zeolite L. The deficiencies of the prior art are overcome by using the first conventional reforming catalyst to provide a product stream to the second, non-acidic, high-selectivity catalyst. There is no suggestion in Buss of the three-zone reforming process of the present invention.

U.S. Pat. No. 4,985,132 (Moser et aL) teaches a multizone catalytic reforming process, with the catalyst of the initial zone containing platinum-germanium on a refractory inorganic oxide and the terminal catalyst zone being a moving-bed system with associated continuous catalyst regeneration. However, there is no disclosure of an L-zeolite component.

U.S. Pat. No. 5,190,638 (Swan et aL) teaches reforming in a moving-bed continuous-catalyst-regeneration mode to produce a partially reformed stream to a second reforming zone preferably using a catalyst having acid functionality at 100–500 psig, but does not disclose the use of a nonacidic zeolitic catalyst.

A reforming process comprising three stages with a bifunctional catalyst followed by a zeolitic catalyst followed by a bifunctional catalyst is taught in patent application Ser. No. 08/963,739. However, the '739 application does not disclose a lanthanide component of the bifunctional catalyst.

SUMMARY OF THE INVENTION

It is an object of the present invention to provide a catalytic reforming process which effects an improved product yield structure.

This invention is based on the discovery that a combination of bifunctional catalytic reforming and zeolitic reforming in a sandwich configuration shows surprising improvements in aromatics yields relative to the prior art.

One embodiment of the present invention is directed toward the catalytic reforming of a hydrocarbon feedstock by contacting the feedstock sequentially with a catalyst system which comprises a first bifunctional catalyst comprising a platinum-group metal, a metal promoter, a refractory inorganic oxide and a halogen in an first catalyst zone; a zeolitic reforming catalyst comprising a nonacidic zeolite and a platinum-group metal in a zeolitic-reforming zone; and a terminal bifunctional catalyst comprising a platinum-group metal, a metal promoter, a refractory inorganic oxide and a halogen in a terminal catalyst zone. The first and terminal bifunctional reforming catalysts preferably are the same catalyst. Optimally, the first and terminal catalysts comprise a platinum-group metal component, a lanthanide-series metal component, a refractory inorganic oxide and a halogen component. Preferably, the zeolitic reforming catalyst comprises a nonacidic L-zeolite and platinum.

In one embodiment, the terminal catalyst zone comprises a moving-bed system with continuous catalyst regeneration. An alternative embodiment of the present invention is a catalytic reforming process combination in which a hydrocarbon feedstock is processed successively in a continuous-reforming section containing a bifunctional catalyst and in a zeolitic-reforming zone containing a zeolitic reforming catalyst, followed by processing once again in a continuous-reforming section. The zeolitic-reforming zone may be an add-on as an intermediate reactor to expand the throughput and/or enhance product quality of an existing continuous-reforming process.

These as well as other objects and embodiments will become apparent upon reading of the detailed description of the invention.

DESCRIPTION OF THE PREFERRED EMBODIMENTS

A broad embodiment of the present invention is directed to a catalytic reforming process which comprises a sandwich configuration in sequence of a bifunctional reforming catalyst, a zeolitic reforming catalyst and a bifunctional reforming catalyst. Preferably, the invention comprises catalytic reforming process with the sequence of contacting a hydrocarbon feedstock with a first bifunctional catalyst comprising a platinum-group metal component, a lanthanide-series metal component, a refractory inorganic oxide, and a halogen component in an first reforming zone at first reforming conditions to obtain a first effluent; contacting the first effluent with a zeolitic reforming catalyst comprising a non-acidic zeolite, an alkali metal component and a platinum-group metal component in a zeolitic-reforming zone at second reforming conditions to obtain an aromatized effluent; and contacting the aromatized effluent with a terminal bifunctional reforming catalyst comprising a platinum-group metal component, a lanthanide-series metal component, a refractory inorganic oxide, and a halogen component in a terminal reforming zone at terminal reforming conditions to obtain an aromatics-rich product.

The basic configuration of a catalytic reforming process is known in the art. The hydrocarbon feedstock and a hydrogen-rich gas are preheated and charged to a reforming zone containing generally two or more, and typically from two to five, reactors in series. Suitable heating means are provided between reactors to compensate for the net endothermic heat of reaction in each of the reactors.

The individual first, intermediate and terminal catalyst zones respectively containing the first, intermediate and terminal catalysts are typically each located in separate reactors, although it is possible that the catalyst zones could be separate beds in a single reactor. Each catalyst zone may be located in two or more reactors with suitable heating means provided between reactors as described hereinabove, for example with the first catalyst zone located in the first reactor and the terminal catalyst zone in three subsequent reactors. The segregated catalyst zones also may be separated by one or more reaction zones containing a catalyst composite having a different composition from either of the catalyst composites of the present invention.

Preferably the first catalyst comprises from about 10% to about 50%, the intermediate catalyst comprises from about 20% to about 60% and the terminal catalyst comprises from about 30% to about 70% of the total mass of catalysts in all of the catalyst zones.

The catalysts are contained in a fixed-bed system or a moving-bed system with associated continuous catalyst regeneration whereby catalyst may be continuously withdrawn, regenerated and returned to the reactors. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and return to the reactors of the reactivated catalyst as described herein; or: (4) a hybrid system with semiregenerative and continuous-regeneration provisions in the same zone. The preferred embodiments of the present invention are either a fixed-bed semiregenerative system or a hybrid system of a fixed-bed reactor in a semiregenerative zeolitic-reforming zone and a moving-bed reactor with continuous bifunctional catalyst regeneration in a continuous-reforming section. In one embodiment of the hybrid system, the zeolitic reforming zone is added to an existing continuous-reforming process unit to upgrade an intermediate partially reformed stream and enhance the throughput and/or product quality obtained in the continuous-reforming process.

The hydrocarbon feedstock comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 160°–210° C., or it may represent a narrower range with a lower final boiling point. Paraffinic feedstocks, such as naphthas from Middle East crudes having a final boiling point within the range of about 100°–175° C., are advantageously processed since the process effectively dehydrocyclizes paraffins to aromatics. Raffinates from aromatics extraction, containing principally low-value $C_6$–$C_8$ paraffins which can be converted to valuable B-T-X aromatics, are favorable alternative hydrocarbon feedstocks.

The hydrocarbon feedstock to the present process contains small amounts of sulfur compounds, amounting to generally less than 10 mass parts per million (ppm) on an elemental basis. Preferably the hydrocarbon feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(IUPAC 6) and VIII(IUPAC 9-10) of the Periodic Table. [See Cotton and Wilkinson, *Advanced Inorganic Chemistry*, John Wiley & Sons (Fifth Edition, 1988)]. Alternatively or in addition to the conventional hydrotreating, the pretreating step may comprise contact with sorbents capable of removing sulfurous and other contaminants. These sorbents may include but are not limited to zinc oxide, iron sponge, high-surface-area sodium, high-surface-area alumina, activated carbons and molecular sieves; excellent results are obtained with a nickel-on-alumina sorbent. Preferably, the pretreating step will provide the zeolitic reforming catalyst with a hydrocarbon feedstock having low sulfur levels disclosed in the prior art as desirable reforming feedstocks, e.g., 1 ppm to 0.1 ppm (100 ppb).

The pretreating step may achieve very low sulfur levels in the hydrocarbon feedstock by combining a relatively sulfur-tolerant reforming catalyst with a sulfur sorbent. The sulfur-tolerant reforming catalyst contacts the contaminated feedstock to convert most of the sulfur compounds to yield an $H_2S$-containing effluent. The $H_2S$-containing effluent contacts the sulfur sorbent, which advantageously is a zinc oxide or manganese oxide, to remove $H_2S$. Sulfur levels well below 0.1 mass ppm may be achieved thereby. It is within the ambit of the present invention that the pretreating step be included in the present reforming process.

The feedstock may contact the respective catalysts in each of the respective reactors in either upflow, downflow, or radial-flow mode. Since the present reforming process operates at relatively low pressure, the low pressure drop in a radial-flow reactor favors the radial-flow mode.

First reforming conditions comprise a pressure of from about 100 kPa to 6 MPa (absolute) and preferably from 100 kPa to 1 MPa (abs). Excellent results have been obtained at operating pressures of about 450 kPa or less. Free hydrogen, usually in a gas containing light hydrocarbons, is combined with the feedstock to obtain a mole ratio of from about 0.1 to 10 moles of hydrogen per mole of $C_5$+ hydrocarbons. Space velocity with respect to the volume of first reforming catalyst is from about 0.2 to 20 $hr^{-1}$. Operating temperature is from about 400° to 560° C.

The first reforming zone produces an aromatics-enriched first effluent stream. Most of the naphthenes in the feedstock are converted to aromatics. Paraffins in the feedstock are primarily isomerized, hydrocracked, and dehydrocyclized, with heavier paraffins being converted to a greater extent than light paraffins with the latter therefore predominating in the effluent.

The refractory support of the first reforming catalyst should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The refractory support of the first reforming catalyst favorably comprises an inorganic oxide, preferably alumina, with gamma- or eta-alumina being particularly preferred.

The alumina powder may be formed into any shape or form of carrier material known to those skilled in the art such as spheres, extrudates, rods, pills, pellets, tablets or granules. Spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass- %. The resulting dough is extruded through a suitably shaped and sized die to form extrudate particles, which are dried and calcined by known methods. Alternatively, spherical particles can be formed from the extrudates by rolling the extrudate particles on a spinning disk.

The particles are usually spheroidal and have a diameter of from about 1/16th to about 1/8th inch (1.5–3.1 mm), though they may be as large as 1/4th inch (6.35 mm). In a particular regenerator, however, it is desirable to use catalyst particles which fall in a relatively narrow size range. A preferred catalyst particle diameter is 1/16th inch (3.1 mm).

An essential component of the first reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalyst in a reduced state. The platinum component generally comprises from about 0.01 to 2 mass- % of the catalyst, preferably 0.05 to 1 mass- %, calculated on an elemental basis.

It is within the scope of the present invention that the first reforming catalyst contains a metal promoter to modify the effect of the preferred platinum component. Such metal promoters may include Group IVA (IUPAC 14) metals, other Group VIII (IUPAC 8-10) metals, rhenium, indium, gallium, zinc, uranium, dysprosium, thallium and mixtures thereof, with the Group IVA (IUPAC 14) metals, rhenium and indium being preferred. Excellent results are obtained when the first reforming catalyst contains a tin component. Catalytically effective amounts of such metal modifiers may be incorporated into the catalyst by any means known in the art.

A lanthanide-series metal is a highly favored component of the present catalyst. Included in the lanthanide series are lanthanum, cerium, praseodymium, neodymium, promethium, samarium, europium, gadolinium, terbium, dysprosium, holmium, erbium, thulium, ytterbium and lutetium. Preferred elements, in addition to the aforementioned cerium, are those which are capable of forming stable +2 ions, i.e., europium, samarium and ytterbium (*CRC Handbook of Chemistry and Physics,* 75th Edition 1994–1995, CRC Press, Inc.), with europium being favored. The lanthanide-metal component may consist essentially of one of the favored elements or may comprise mixtures of elements. The lanthanide-metal component may in general be present in the catalytic composite in any catalytically available form such as the elemental metal, a compound such as the oxide, hydroxide, halide, oxyhalide, aluminate, or in chemical combination with one or more of the other ingredients of the catalyst. Although not intended to so restrict the present invention, it is believed that best results are obtained when the lanthanide-metal component is present in the composite in a form wherein substantially all of the lanthanide moiety is in an oxidation state above that of the elemental metal such as in the form of the oxide, oxyhalide or halide or in a mixture thereof.

The lanthanide-series metal component can be present in the catalyst in any amount which is catalytically effective, with good results obtained with about 0.05 to about 5 mass- % lanthanide on an elemental basis in the catalyst. Best results are ordinarily achieved with about 0.2 to about 2 mass- % lanthanide, calculated on an elemental basis. The preferred atomic ratio of lanthanide to platinum group metal for this catalyst is at least about 1.3:1, preferably about 1.5:1 or more, and especially about 2:1 or more.

The lanthanide-series metal component can be incorporated into the catalytic composite in any suitable manner known to the art, such as by coprecipitation, cogellation or coextrusion with the porous carrier material, ion exchange with the gelled carrier material, or impregnation of the porous carrier material either after, before, or during the period when it is dried and calcined. It is intended to include within the scope of the present invention all conventional methods for incorporating and simultaneously distributing a metallic component in a catalytic composite in a desired manner, as the particular method of incorporation used is not deemed to be an essential feature of the present invention. Preferably the method used results in a relatively uniform dispersion of the lanthanide moiety in the carrier material, although methods which result in non-uniform lanthanide distribution are within the scope of the present invention.

One suitable method of incorporating the lanthanide-metal component into the catalytic composite involves cogelling or coprecipitating the lanthanide-metal component in the form of the corresponding hydrous oxide or oxyhalide during the preparation of the preferred carrier material, alumina. This method typically involves the addition of a suitable sol-soluble or sol-dispersible lanthanide compound such as the lanthanide trichloride, lanthanide oxide, and the like to the alumina hydrosol and then combining the lanthanide-containing hydrosol with a suitable gelling agent and dropping the resulting mixture into an oil bath, etc., as explained in detail hereinbefore. Alternatively, the lanthanide compound can be added to the gelling agent. After drying and calcining the resulting gelled carrier material in air, an intimate combination of alumina and lanthanide oxide and/or oxychloride is obtained.

An alternative method of incorporating the lanthanide-metal component into the catalytic composite involves utilization of a soluble, decomposable compound of lanthanide in solution to impregnate the porous carrier material. In general, the solvent used in this impregnation step is selected on the basis of the capability to dissolve the desired lanthanide compound and to hold it in solution until it is evenly distributed throughout the carrier material without adversely affecting the carrier material or the other ingredients of the catalyst. Suitable solvents comprise alcohols, ethers, acids, and the like, with an aqueous, acidic solution being preferred.

The first reforming catalyst may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %. calculated on an elemental basis, of the final catalyst.

An optional ingredient of the first reforming catalyst is a zeolite, or crystalline aluminosilicate. Preferably, however, this catalyst contains substantially no zeolite component. The first reforming catalyst may contain a non-zeolitic molecular sieve, as disclosed in U.S. Pat. No. 4,741,820 which is incorporated herein by reference thereto.

The first reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially waterfree reduction step at a temperature of about 300° to 550° C. for 0.5 to 10 hours or more. Further details of the preparation and activation of embodiments of the first reforming catalyst are disclosed in U.S. Pat. No. 4,677,094 (Moser et al.), which is incorporated into this specification by reference thereto.

The first effluent from the first reforming zone passes to a zeolitic-reforming zone for selective formation of aromatics. Preferably free hydrogen accompanying the first effluent is not separated prior to the processing of the first effluent in the zeolitic-reforming zone, i.e., the first and zeolitic-reforming zones are within the same hydrogen circuit. It is within the scope of the invention that a supplementary naphtha feed is added to the first effluent as feed to the zeolitic-reforming zone to obtain a supplementary reformate product. The optional supplementary naphtha feed has characteristics within the scope of those described for the hydrocarbon feedstock, but optimally is lower-boiling and thus more favorable for production of lighter aromatics than the feed to the continuous-reforming section. The first effluent, and optionally the supplementary naphtha feed, contact a zeolitic reforming catalyst at second reforming conditions in the zeolitic-reforming zone.

The hydrocarbon feedstock contacts the zeolitic reforming catalyst in the zeolitic-reforming zone to obtain an aromatized effluent, with a principal reaction being dehydrocyclization of paraffinic hydrocarbons remaining in the first effluent. Second reforming conditions used in the zeolitic-reforming zone of the present invention include a pressure of from about 100 kPa to 6 MPa (absolute), with the preferred range being from 100 kPa to 1 MPa (absolute) and a pressure of about 450 kPa or less at the exit of the last reactor being especially preferred. Free hydrogen is supplied to the zeolitic-reforming zone in an amount sufficient to correspond to a ratio of from about 0.1 to 10 moles of hydrogen per mole of hydrocarbon feedstock, with the ratio preferably being no more than about 6 and more preferably no more than about 5. By "free hydrogen" is meant molecular $H_2$, not combined in hydrocarbons or other compounds. The volume of the contained zeolitic reforming catalyst corresponds to a liquid hourly space velocity of from about 1 to 40 $hr^{-1}$, value of preferably at least about 7 $hr^{-1}$ and optionally about 10 $hr^{-}$or more.

The operating temperature, defined as the maximum temperature of the combined hydrocarbon feedstock, free hydrogen, and any components accompanying the free hydrogen, generally is in the range of 260° to 560° C. This temperature is selected to achieve optimum overall results from the combination of the continuous- and zeolitic-reforming zones with respect to yields of aromatics in the product, when chemical aromatics production is the objective, or properties such as octane number when gasoline is the objective. Hydrocarbon types in the feed stock also influence temperature selection, as the zeolitic reforming catalyst is particularly effective for dehydrocyclization of light paraffins. Naphthenes generally are dehydrogenated to a large extent in the prior continuous-reforming reactor with a concomitant decline in temperature across the catalyst bed due to the endothermic heat of reaction. Initial reaction temperature generally is slowly increased during each period of operation to compensate for the inevitable catalyst deactivation. The temperature to the reactors of the continuous- and zeolitic-reforming zones optimally are staggered, i.e., differ between reactors, in order to achieve product objectives with respect to such variables as ratios of the different aromatics and concentration of nonaromatics. Usually the maximum temperature in the zeolitic-reforming zone is lower than that in the first reforming zone, but the temperature in the zeolitic-reforming zone may be higher depending on catalyst condition and product objectives.

The zeolitic-reforming zone may comprise a single reactor containing the zeolitic reforming catalyst or, alternatively, two or more parallel reactors with valving as known in the art to permit alternative cyclic regeneration. The choice between a single reactor and parallel cyclic reactors depends inter alia on the reactor volume and the need to maintain a high degree of yield consistency without interruption; preferably, in any case, the reactors of the zeolitic reforming zone are valved for removal from the process combination so that the zeolitic reforming catalyst may be regenerated or replaced while the continuous reforming zone remains in operation.

In an alternative embodiment, it is within the ambit of the invention that the zeolitic-reforming zone comprises two or more reactors with interheating reactors to raise the temperature and maintain dehydrocyclization conditions. This may be advantageous since a major reaction occurring in the zeolitic-reforming zone is the dehydrocyclization of paraffins to aromatics along with the usual dehydrogenation of naphthenes, and the resulting endothermic heat of reaction may cool the reactants below the temperature at which reforming takes place before sufficient dehydrocyclization has occurred.

The zeolitic reforming catalyst contains a non-acidic zeolite, an alkali-metal component and a platinum-group metal component. It is essential that the zeolite, which preferably is LTL or L-zeolite, be non-acidic since acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

Generally the L-zeolite is composited with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass- % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass- % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the zeolitic reforming catalyst.

An alkali-metal component is an essential constituent of the zeolitic reforming catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic L-zeolite. Surface-deposited alkali metal also may be present as described in U.S. Pat. No. 4,619,906, incorporated herein in by reference thereto.

A platinum-group metal component is another essential feature of the zeolitic reforming catalyst, with a platinum component being preferred. The platinum may exist within the catalyst as a compound such as the oxide, sulfide, halide, or oxyhalide, in chemical combination with one or more other ingredients of the catalyst, or as an elemental metal. Best results are obtained when substantially all of the platinum exists in the catalyst in a reduced state. The platinum component generally comprises from about 0.05 to 5 mass- % of the catalyst, preferably 0.05 to 2 mass- %, calculated on an elemental basis.

It is within the scope of the present invention that the catalyst may contain other metal components known to modify the effect of the preferred platinum component. Such metal modifiers may include Group IVA(IUPAC 14) metals, other Group VIII(IUPAC 8-10) metals, rhenium, indium, gallium, zinc, uranium, dysprosium, thallium and mixtures thereof. Catalytically effective amounts of such metal modifiers may be incorporated into the catalyst by any means known in the art.

The final zeolitic reforming catalyst generally is dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the zeolitic reforming catalyst are disclosed, e.g., in U.S. Pat. No. 4,619,906 (Lambert et al) and 4,822,762 (Ellig et al.), which are incorporated into this specification by reference thereto.

The aromatized effluent from the zeolitic-reforming zone contacts a terminal bifunctional reforming catalyst in a terminal reforming zone to complete the reforming reactions to obtain an aromatics-rich product. Free hydrogen accompanying the first effluent preferably is not separated prior to the processing of the aromatized effluent in the terminal reforming zone, i.e., the first, zeolitic-, and terminal reforming zones preferably are within the same hydrogen circuit.

The aromatized effluent is processed at terminal reforming conditions according to the same parameters as described hereinabove for first reforming conditions. These conditions comprise a pressure of from about 100 kPa to 6 MPa (absolute), preferably from 100 kPa to 1 MPa (abs), and most preferably at operating pressures of about 450 kPa or less. Free hydrogen, usually in a gas containing light hydrocarbons, is combined with the feedstock to obtain a mole ratio of from about 0.1 to 10 moles of hydrogen per mole of $C_5$+ hydrocarbons. Space velocity with respect to the volume of first reforming catalyst is from about 0.2 to 10 $hr^{-1}$. Operating temperature is from about 400° to 560° C.

The terminal bifunctional reforming catalyst comprises a composition as described hereinabove for the first bifunctional reforming catalyst. Preferably, the first and terminal reforming catalysts are the same bifunctional reforming catalyst.

The terminal reforming zone preferably comprises continuous reforming with continuous catalyst regeneration. Optionally, the first reforming zone comprises continuous reforming. The first and terminal reforming zones may comprise a single continuous-reforming section, with a first effluent being withdrawn at an intermediate point, processed in the zeolitic-reforming zone to obtain an aromatized effluent which is processed in the terminal reforming zone section of the continuous-reforming section.

During the reforming reaction, catalyst particles become deactivated as a result of mechanisms such as the deposition of coke on the particles to the point that the catalyst is no longer useful. Such deactivated catalyst must be regenerated and reconditioned before it can be reused in a reforming process. Continuous reforming permits higher operating severity by maintaining the high catalyst activity of near-fresh catalyst through regeneration cycles of a few days. A moving-bed system has the advantage of maintaining production while the catalyst is removed or replaced. Catalyst particles pass by gravity through one or more reactors in a moving bed and is conveyed to a continuous regeneration zone. Continuous catalyst regeneration generally is effected by passing catalyst particles downwardly by gravity in a moving-bed mode through various treatment zones in a regeneration vessel. Although movement of catalyst through the zones is often designated as continuous in practice it is semi-continuous in the sense that relatively small amounts of catalyst particles are transferred at closely spaced points in time. For example, one batch per minute may be withdrawn from the bottom of a reaction zone and withdrawal may take one-half minute; e.g., catalyst particles flow for one-half minute in the one-minute period. Since the inventory in the reaction and regeneration zones generally is large in relation to the batch size, the catalyst bed may be envisaged as moving continuously.

In a continuous-regeneration zone, catalyst particles are contacted in a combustion zone with a hot oxygen-containing gas stream to remove coke by oxidation. The catalyst usually next passes to a drying zone to remove water by contacting a hot, dry air stream. Dry catalyst is cooled by direct contact with an air stream. Optimally, the catalyst also is halogenated in a halogenation zone located below the combustion zone by contact with a gas containing a halogen component. Finally, catalyst particles are reduced with a hydrogen-containing gas in a reduction zone to obtain reconditioned catalyst particles which are conveyed to the moving-bed reactor. Details of continuous catalyst regeneration, particularly in connection with a moving-bed reforming process, are disclosed below and inter alia in U.S. Pat. No. 3,647,680; 3,652,231; 3,692,496; and 4,832,921, all of which are incorporated herein by reference.

Spent catalyst particles from the continuous-reforming section first are contacted in the regeneration zone with a hot oxygen-containing gas stream in order to remove coke which accumulates on surfaces of the catalyst during the reforming reaction. Coke content of spent catalyst particles may be as much as 20% of the catalyst weight, but 5–7% is a more typical amount. Coke comprises primarily carbon with a relatively small amount of hydrogen, and is oxidized to carbon monoxide, carbon dioxide, and water at temperatures of about 450–550° C. which may reach 600° C. in localized regions. Oxygen for the combustion of coke enters a combustion section of the regeneration zone in a recycle gas containing usually about 0.5 to 1.5% oxygen by volume. Flue gas made up of carbon monoxide, carbon dioxide, water, unreacted oxygen, chlorine, hydrochloric acid, nitrous oxides, sulfur oxides and nitrogen is collected from the combustion section, with a portion being withdrawn from the regeneration zone as flue gas. The remainder is combined with a small amount of oxygen-containing makeup gas, typically air in an amount of roughly 3% of the total gas, to replenish consumed oxygen and returned to the combustion section as recycle gas. The arrangement of a typical combustion section may be seen in U.S. Pat. No. 3,652,231.

As catalyst particles move downward through the combustion section with concomitant removal of coke, a "breakthrough" point is reached typically about halfway through the section where less than all of the oxygen delivered is consumed. It is known in the art that the present reforming catalyst particles have a large surface area associated with a multiplicity of pores. When the catalyst particles reach the breakthrough point in the bed, the coke remaining on the surface of the particles is deep within the pores and therefore the oxidation reaction occurs at a much slower rate.

Water in the makeup gas and from the combustion step is removed in the small amount of vented flue gas, and therefore builds to an equilibrium level in the recycle-gas loop. The water concentration in the recycle loop optionally may be lowered by drying the air that made up the makeup gas, installing a drier for the gas circulating in the recycle gas loop or venting a larger amount of flue gas from the recycle gas stream to lower the water equilibrium in the recycle gas loop.

Optionally, catalyst particles from the combustion zone pass directly into a drying zone wherein water is evaporated from the surface and pores of the particles by contact with a heated gas stream. The gas stream usually is heated to about 425–600° C. and optionally pre-dried before heating to increase the amount of water that can be absorbed. Preferably the drying gas stream contain oxygen, more preferably with an oxygen content about or in excess of that of air, so that any final residual burning of coke from the inner pores of catalyst particles may be accomplished in the drying zone and so that any excess oxygen that is not consumed in the drying zone can pass upwardly with the flue gas from the combustion zone to replace the oxygen that is depleted through the combustion reaction. Contacting the catalyst particles with a gas containing a high concentration of oxygen also aids in restoring full activity to the catalyst particles by raising the oxidation state of the platinum or other metals contained thereon. The drying zone is designed to reduce the moisture content of the catalyst particles to no more than 0.01 weight fraction based on catalyst before the catalyst particles leave the zone.

Following the optional drying step, the catalyst particles preferably are contacted in a separate zone with a chlorine-containing gas to re-disperse the noble metals over the surface of the catalyst. Redispersion is needed to reverse the agglomeration of noble metals resulting from exposure to high temperatures and steam in the combustion zone. Redispersion is effected at a temperature of between about 425–600° C., preferably about 510–540°. A concentration of chlorine on the order of 0.01 to 0.2 mol.% of the gas and the presence of oxygen are highly beneficial to promoting rapid and complete re-dispersion of the platinum-group metal to obtain redispersed catalyst particles.

Regenerated and redispersed catalyst is reduced to change the noble metals on the catalyst to an elemental state through contact with a hydrogen-rich reduction gas before being used for catalytic purposes. Although reduction of the oxidized catalyst is an essential step in most reforming operations, the step is usually performed just ahead or within the reaction zone and is not generally considered a part of the apparatus within the regeneration zone. Reduction of the highly oxidized catalyst with a relatively pure hydrogen reduction gas at a temperature of about 450–550° C., preferably about 480–510° C., to provide a reconditioned catalyst.

During lined-out operation of the continuous-reforming section, most of the catalyst supplied to the zone is a first reforming catalyst which has been regenerated and reconditioned as described above. A portion of the catalyst to the reforming zone may be first reforming catalyst supplied as makeup to overcome losses to deactivation and fines, particularly during reforming-process startup, but these quantities are small, usually less than about 0.1%, per regeneration cycle. The first reforming catalyst is a dual-function composite containing a metallic hydrogenation-dehydrogenation, preferably a platinum-group metal component, on a refractory support which preferably is an inorganic oxide which provides acid sites for cracking and isomerization. The first reforming catalyst effects dehydrogenation of naphthenes contained in the feedstock as well as isomerization, cracking and dehydrocyclization.

The addition of a zeolitic-reforming zone to an existing continuous-reforming section, i.e., an installation in which the major equipment for a moving-bed reforming unit with continuous catalyst regeneration is in place, is a particularly advantageous embodiment of the present invention. A continuous-regeneration reforming unit is relatively capital-intensive, generally being oriented to high-severity reforming and including the additional equipment for continuous catalyst regeneration. By adding on a zeolitic-reforming zone which is particularly effective in converting light paraffins from an first effluent produced by continuous reforming, some options would be open for improvement of the overall catalytic-reforming operation:

Increase severity, in terms of overall aromatics yields or product octane number.

Increase throughput of the continuous-reforming section by at least about 5%, preferably at least about 10%, optionally at least 20%, and in some embodiments 30% or more through reduced continuous-reforming severity. Such reduced severity would be effected by one or more of operating at higher space velocity, lower hydrogen-to-hydrocarbon ratio and lower catalyst circulation in the continuous-reforming section. The required product quality then would be effected by processing the first effluent from the continuous-reforming section in the zeolitic-reforming zone.

Increase selectivity, reducing severity of the continuous-reforming operation and selectively converting residual paraffins in the first effluent to aromatics.

The aromatics content of the $C_5$+ portion of the effluent is increased by at least 5 mass- % relative to the aromatics content of the hydrocarbon feedstock. The composition of the aromatics depends principally on the feedstock composition and operating conditions, and generally will consist principally of $C_6$–$C_{12}$ aromatics.

The present reforming process produces an aromatics-rich product contained in a reformed effluent containing hydrogen and light hydrocarbons. Using techniques and equipment known in the art, the reformed effluent from the terminal reforming zone usually is passed through a cooling zone to a separation zone. In the separation zone, typically maintained at about 0° to 65° C., a hydrogen-rich gas is separated from a liquid phase. Most of the resultant hydrogen-rich stream optimally is recycled through suitable compressing means back to the first reforming zone, with a portion of the hydrogen being available as a net product for use in other sections of a petroleum refinery or chemical plant. The liquid phase from the separation zone is normally withdrawn and processed in a fractionating system in order to adjust the concentration of light hydrocarbons and to obtain the aromatics-rich product.

EXAMPLE

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

A series of reforming staged-loading options was studied by kinetic modeling, using data for different catalysts derived from pilot-plant and commercial operations. The two catalysts used in the study were respectively a bifunctional catalyst ("B") and a zeolitic catalyst ("Z") and had the following compositions in mass- %:

Catalyst B: 0.376% Pt and 0.25% Ge on an extruded alumina support

Catalyst Z: 0.82% Pt on silica-bound nonacidic L-zeolite

A four-reactor system was used for the model, loaded with the respective catalysts as indicated below and producing benzene, toluene and $C_8$ aromatics in mass- % yields as indicated:

| First | ----------→ | | Terminal | Benzene | Toluene | $C_8$ Aromatics |
|---|---|---|---|---|---|---|
| B | Z | Z | B | 7.12 | 23.15 | 18.41 |
| B | Z | B | B | 6.71 | 21.92 | 18.35 |
| Z | Z | B | B | 6.95 | 20.78 | 18.16 |
| Z | Z | Z | B | 7.29 | 22.17 | 18.07 |
| Z | B | Z | B | 6.95 | 22.44 | 17.73 |
| B | Z | B | Z | 7.13 | 23.49 | 17.71 |
| Z | Z | B | Z | 7.27 | 22.42 | 17.57 |
| B | B | Z | B | 8.17 | 23.16 | 17.45 |
| Z | B | B | B | 7.07 | 20.93 | 17.02 |
| B | Z | Z | Z | 7.82 | 24.53 | 16.93 |
| Z | B | Z | Z | 7.48 | 23.80 | 16.55 |
| Z | Z | Z | Z | 7.93 | 23.65 | 16.46 |
| Z | B | B | Z | 7.32 | 22.71 | 16.40 |
| B | B | Z | Z | 8.50 | 24.55 | 16.36 |
| B | B | B | B | 7.55 | 21.61 | 15.95 |
| B | B | B | Z | 9.03 | 23.41 | 15.81 |

The sandwich loadings of bifunctional first and terminal catalysts and an intermediate zeolitic catalyst were particularly effective for production of $C_8$ aromatics, toward which most large modern aromatics complexes are directed.

We claim:

1. A process for the catalytic reforming of hydrocarbons comprising contacting a hydrocarbon feedstock in a catalyst system which comprises at least three sequential catalyst zones to obtain a reformate, comprising the steps of:

(a) contacting the feedstock with a first bifunctional catalyst comprising a platinum-group metal component, a lanthanide-series metal component, a refractory inorganic oxide, and a halogen component in an first reforming zone at first reforming conditions to obtain a first effluent;

(b) contacting the first effluent with a zeolitic reforming catalyst comprising a non-acidic zeolite, an alkali metal component and a platinum-group metal component in a zeolitic-reforming zone at second reforming conditions to obtain an aromatized effluent; and, (c) contacting the aromatized effluent with a terminal bifunctional reforming catalyst comprising a platinum-group metal component, a lanthanide-series metal component, a refractory inorganic oxide, and a halogen component in a terminal reforming zone at terminal reforming conditions to obtain an aromatics-rich product.

2. The process of claim 1 wherein the first bifunctional reforming catalyst and the terminal bifunctional reforming catalyst are the same bifunctional reforming catalyst.

3. The process of claim 1 wherein the terminal reforming zone is a continuous-reforming zone.

4. The process of claim 3 wherein the first reforming zone is a continuous-reforming zone and the first bifunctional reforming catalyst and the terminal bifunctional reforming catalyst are the same bifunctional reforming catalyst.

5. The process of claim 4 wherein the first and terminal reforming zones comprise a single continuous-reforming section, and the aromatized effluent contacts the bifunctional reforming catalyst in the next reactor in sequence of the continuous-reforming section after the first reforming zone.

6. The process of claim 1 wherein the platinum-group metal component of the zeolitic reforming catalyst comprises a platinum component.

7. The process of claim 1 wherein the nonacidic zeolite comprises potassium-form L-zeolite.

8. The process of claim 1 wherein the alkali-metal component comprises a potassium component.

9. The process of claim 2 wherein the platinum-group metal component of the bifunctional reforming catalyst comprises a platinum component.

10. The process of claim 2 wherein the refractory inorganic oxide of the bifunctional reforming catalyst comprises alumina.

11. The process of claim 1 wherein the lanthanide-metal component of one or both of the first and terminal bifunctional catalysts comprises a cerium component.

12. The process of claim 2 wherein the lanthanide-metal component of the first and terminal bifunctional catalysts comprises a cerium component.

13. The process of claim 1 wherein the lanthanide-metal component of one or both of the first and terminal bifunctional catalysts is selected from the group consisting of europium, samarium and ytterbium and mixtures thereof.

14. A process for the catalytic reforming of hydrocarbons comprising contacting a hydrocarbon feedstock in a catalyst system which comprises at least three sequential catalyst zones to obtain a reformate, comprising the steps of:

(a) contacting the feedstock with a first bifunctional catalyst comprising a platinum-group metal component, a lanthanide-metal component, a refractory inorganic oxide, and a halogen component in an first reforming zone at first reforming conditions comprising a pressure of from about 100 kPa to 1 MPa, liquid hourly space velocity of from about 0.2 to 20 $hr^{-1}$, mole ratio of hydrogen to $C_5$+ hydrocarbons of about 0.1 to 10, and temperature of from about 400° to 560° C. to obtain a first effluent;

(b) contacting the first effluent with a zeolitic reforming catalyst comprising a non-acidic zeolite, an alkali metal component and a platinum-group metal component in a zeolitic-reforming zone at second reforming conditions comprising a pressure of from about 100 kPa to 6 MPa, a liquid hourly space velocity of from about 1 to 40 $hr^{-1}$ and a temperature of from about 260° to 560° C. to obtain an aromatized effluent; and, (c) contacting the aromatized effluent with a terminal bifunctional reforming catalyst comprising a platinum-group metal component, a metal promoter, a refractory inorganic oxide, and a halogen component in a terminal reforming zone at terminal reforming conditions comprising a pressure of from about 100 kPa to 1 MPa, liquid hourly space velocity of from about 0.2 to 10 $hr^{-1}$, mole ratio of hydrogen to $C_5$+ hydrocarbons of about 0.1 to 10, and temperature of from about 400° to 560° C. to obtain an aromatics-rich product.

15. The process of claim 14 wherein the first bifunctional reforming catalyst and the terminal bifunctional reforming catalyst are the same bifunctional reforming catalyst.

16. The process of claim 14 wherein the terminal reforming zone is a continuous-reforming zone.

17. The process of claim 16 wherein the first reforming zone is a continuous-reforming zone and the first bifunctional reforming catalyst and the terminal bifunctional reforming catalyst are the same bifunctional reforming catalyst.

18. The process of claim 17 wherein the first and terminal reforming zones comprise a single continuous-reforming section, and the aromatized effluent contacts the bifunctional reforming catalyst in the next reactor in sequence of the continuous-reforming section after the first reforming zone.

19. The process of claim 14 wherein the pressure in each of the first, zeolitic- and terminal reforming zones is between about 100 kPa and 1 MPa.

20. The process of claim 19 wherein the pressure in each of the first, zeolitic- and terminal reforming is about 450 kPa or less.

* * * * *